United States Patent [19]

Stoecklin et al.

[11] Patent Number: 4,778,132

[45] Date of Patent: Oct. 18, 1988

[54] CONSTRUCTION FOR PINWHEEL MOUNTED ON A DRAGON STYLE KITE

[75] Inventors: Carl E. Stoecklin; John F. Stoecklin, both of 2996 Wardall Ave., Apt. 10, Cincinnati, Ohio 45211; Robert E. Polewski, Cincinnati, Ohio

[73] Assignees: Carl E. Stoecklin; John F. Stoecklin, both of Cincinnati, Ohio

[21] Appl. No.: 894,359

[22] Filed: Aug. 7, 1986

[51] Int. Cl.[4] ..... A63H 27/08

[52] U.S. Cl. ..... 244/155 R; 446/217; 24/141

[58] Field of Search ..... 244/155 R, 153 R; 446/217, 218; 24/141

[56] References Cited

U.S. PATENT DOCUMENTS

| | | | |
|---|---|---|---|
| 959,308 | 5/1910 | Carr | 24/141 |
| 1,334,163 | 3/1920 | Neuberth | 24/141 |
| 1,840,951 | 1/1932 | Heisenfeldt | 244/155 R |
| 1,914,822 | 6/1933 | Bryan | 244/155 R |
| 2,258,971 | 9/1941 | Hall | 24/141 |
| 2,800,293 | 7/1957 | Kindelberger | 244/155 R |
| 3,252,241 | 5/1966 | Gould | 446/217 |
| 3,276,730 | 10/1966 | Cleveland | 244/153 R |
| 4,072,284 | 2/1978 | Arnstein | 244/153 R |
| 4,557,443 | 12/1985 | Christoffel, Jr. | 244/153 R |

FOREIGN PATENT DOCUMENTS

| | | | |
|---|---|---|---|
| 97306 | 1/1961 | Norway | 446/217 |
| 8424 | of 1895 | United Kingdom . | |
| 6657 | of 1914 | United Kingdom | 244/153 R |

*Primary Examiner*—Galen Barefoot
*Assistant Examiner*—L. M. Fiorito
*Attorney, Agent, or Firm*—Frost & Jacobs

[57] ABSTRACT

The present invention includes a dragon style kite having a pinwheel removably mounted on a center strut. A channel member receives a framing strut and includes a recess. The recess receives a first end of the center strut. A bracket has an upper chamber and a lower chamber. The pinwheel is assembled and rotatably mounted on a spindle. The spindle is slidably inserted into the upper chamber of the bracket. The center strut is slidably inserted into the lower chamber of the bracket and secured. A snap-on-grommet is provided for assembling and aligning tabs of a pinwheel on the spindle. The snap-on-grommet is retained on the spindle by barbs. During flight, the pinwheel freely rotates on the spindle and does not engage the body of sheet material.

9 Claims, 5 Drawing Sheets

CONSTRUCTION FOR PINWHEEL MOUNTED ON A DRAGON STYLE KITE

BACKGROUND OF THE INVENTION

1. Field of the Invention

The present invention relates generally to kites, and more particularly is directed to a construction for stabilizing a pinwheel mounted on a center strut of a dragon style kite.

2. Description of the Prior Art

Kites provide fun and entertainment for individuals of all ages worldwide. Generally, kites are constructed from struts or bars and a flier or body of sheet material for catching the wind. Lightweight materials such as wood, plastic and fiberglass are utilized such as wood, plastic and fiberglass are utilized for struts. Paper, plastic and nylon are common materials for the body since they are lightweight and resist tearing. A bridle is attached to the struts. A kite flying string is tied to the bridle to control the flight of the kite. A kite often includes a tail or tails.

The struts of kites are arranged in various configurations to produce four common designs: (1) box, wherein a triangular or rectangular body is constructed from three or four parallel struts, respectively; (2) diamond-shaped, wherein two struts are mounted perpendicular to each other; (3) delta, wherein struts are arranged to form a triangular body; and (4) dragon style, wherein a center strut is connected near the apex of a U-shaped framing strut. Dragon style kites in particular have long and decorative tails.

To enhance play value of a kite, many designs exist for attaching objects to a kite. For example, U.S. Pat. No. 2,800,293, issued to Kindelberger et al. in 1957, shows a propeller mounting for kites. A propeller having a mounting member is shown mounted to a diamondshaped kite and a box kite.

U.S. Pat. No. 1,840,951, issued to Heisenfeldt et al. in 1932, shows a kite having a propeller mounted thereon. The kite is a diamond kite and includes yokes for stabilizing the propeller.

U.S. Pat. No. 1,914,822, issued to Bryan in 1933, shows a pinwheel mounted to a center strut of a diamond kite. The pinwheel is rotatably mounted on a pin.

U.S. Pat. No. 2,518,768, issued to Fugate in 1949, shows a pair of propellers mounted on opposite ends of the cross bar of a diamond kite. The propellers are mounted on pivot pins which extend through bearing blocks.

U.S. Pat. No. 3,074,673, issued to Williams in 1963, shows a rotary stabilizer mounted on a diamond kite. The stabilizer is mounted on a support which is connected to the struts.

U.S. Pat. No. 4,336,915, issued to Carl. E. Stoecklin and John F. Stoecklin (two of the inventors of the present invention) in 1982, shows a spinner mounted to a center strut of a keel kite. The spinner is mounted on a bracket so that the axis of rotation of the spinner is parallel with the center strut.

Several designs have been set forth for kites resembling a helicopter. Such designs include a propeller attached to the kite construction to simulate propellers of a helicopter. Examples of such patents include the following U.S. Pat. Nos: 2,781,989; 2,893,663; 3,022,967; 2,472,290; and 3,770,229.

Other kite constructions have been designed to simulate airplanes. Such constructions include a propeller designed to increase the thrust and propel a kite during flying. Examples of such kites include the following U.S. Pat. Nos.: 2,349,417; 2,675,199; and 2,987,280.

The prior art teachings of propellers and other spinning objects mounted to a kite do not show a suitable construction for mounting a pinwheel on a center strut of a dragon style kite. During flight, a pinwheel, mounted on a spindle, tends to sway from side to side with gusts of wind. Such rotation and twisting causes a pinwheel to contact the body of sheet material. The pinwheel vanes can damage or tear the sheet material, therefore rendering the kite inoperative. A problem in dragon style kites lies in the stabilization of the pinwheel on the center strut. In diamond-shaped kites, wherein propellers and the like have been installed, the center strut is stabilized by the cross strut. Such inherent stability is not found in the center strut of a dragon kite.

An additional problem in mounting a pinwheel on a kite lies in the stabilization of the pinwheel on the spindle. Wind gusts can also cause a pinwheel and spindle to wobble on the center strut. Such wobbling interferes with and may prevent the pinwheel from spinning. When wobbling, the pinwheel can rip and tear the flier, resulting in loss of flight of the kite.

Consequently, a need exists for improvements in kites for mounting a pinwheel on a center strut of a dragon style kite. Improvements should include a means for stabilizing the center strut of such a kite to prevent the pinwheel from engaging and tearing the body of sheet material. Also it is desirable that such improvements include a means for removably securing and stabilizing a pinwheel to the center strut. Finally, improvements should stabilize pinwheel rotation on a spindle during flight and prevent tearing of the body of sheet material by the pinwheel.

SUMMARY OF THE INVENTION

The present invention includes a dragon style kite having a pinwheel mounted on a center strut. When the kite is flown, the pinwheel is freely rotated by the wind. As the pinwheel rotates, it is stabilized about the center of the kite, thereby preventing rips and tears. A snap-on-grommet permits quick, easy, and economical assembly of the pinwheel to be placed on the spindle. The snap-on-grommet stabilizes the rotation of the pinwheel about the spindle and also helps prevent the pinwheel from tearing the body of sheet material.

The present invention includes a dragon style kite having a pinwheel removably mounted on a center strut. A channel member receives a framing strut and includes a recess. The center strut is inserted into the recess of the channel member. A bracket has an upper chamber and a lower chamber. The pinwheel is rotatably mounted on a spindle. The spindle is slidably inserted into the upper chamber of the bracket. The center strut is slidably inserted into the lower chamber of the bracket and secured. A snap-on-grommet is provided for assembly and aligning tabs of a pinwheel on the spindle. The snap-on-grommet is retained on the spindle by barbs. During flight, the pinwheel freely rotates on the spindle and does not engage the body of sheet material.

DETAILED DESCRIPTION OF THE PREFERRED EMBODIMENTS

Figure 1:
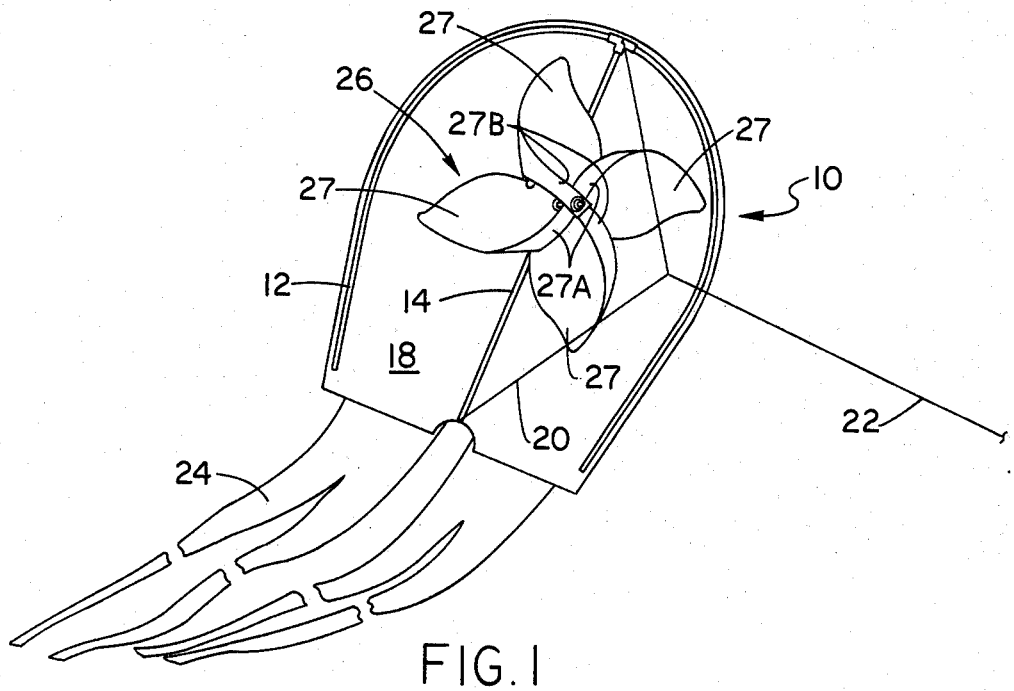
FIG. 1 is a perspective view of an embodiment of the kite of the present invention showing a pinwheel mounted on a center strut.

An embodiment of the kite of the present invention, indicated generally at 10, is illustrated in FIG. 1. The kite 10 includes a U-shaped framing strut 12 and a center strut 14. The cross sections of the framing strut 12 and center strut 14 are non-circular and preferably rectangular. Furthermore, it is desirable that the struts 12 and 14 be tubular. The center strut 14 is mounted at the apex of the framing strut 12 in a manner described below. A body of sheet material 18 (generally paper, plastic, or nylon) is secured to the center strut 14 and the framing strut 12 by glue, heat bonding or other known means. A bridle 20 is securely attached at opposite ends of the center strut 14 and connected to a cord or kite flying string 22. A tail 24 is connected to the kite 10 for balance during flight. A pinwheel 26 is mounted to the center strut 14 so that it faces a viewer during flight.

Figure 2:
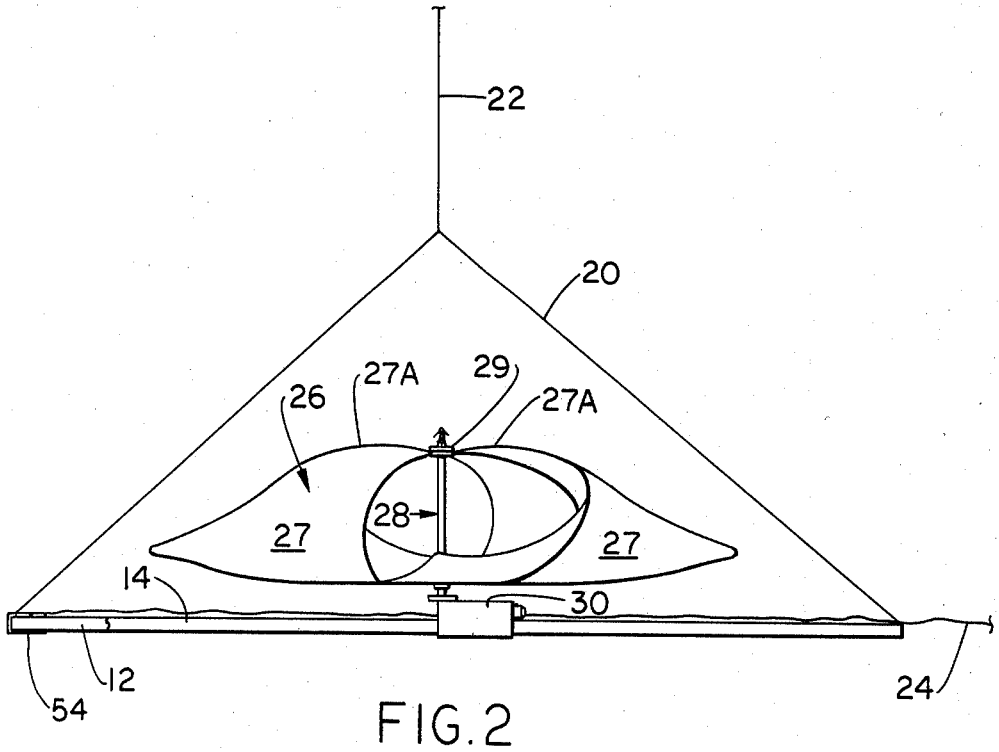
FIG. 2 is a side elevational view of the kite of FIG. 1.

FIG. 2 is a side elevational view of the kite 10 of FIG. 1. The pinwheel 26 is rotatably mounted on a spindle 28. The spindle 28 is secured to a bracket 30, which is secured to the center strut 14 (illustrated in FIGS. 3 & 4). When the kite 10 is flown, force of the wind causes the pinwheel 26 to freely rotate. For purposes of illustration, the pinwheel 26 shown in FIGS. 1 and 2 includes four vanes 27. However, pinwheels of other constructions are within the scope of the present invention. Vane tabs 27A and 27B are secured to the spindle 28 by barbs 38 through a snap-on-grommet 29 or other known fastener.

Figure 3:
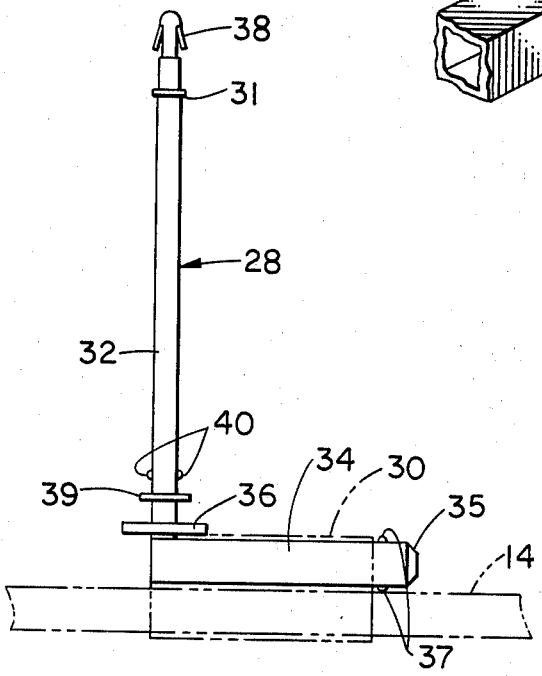
FIG. 3 is an enlarged side view of a spindle for receiving the pinwheel showing a bracket in phantom.
Figure 6:
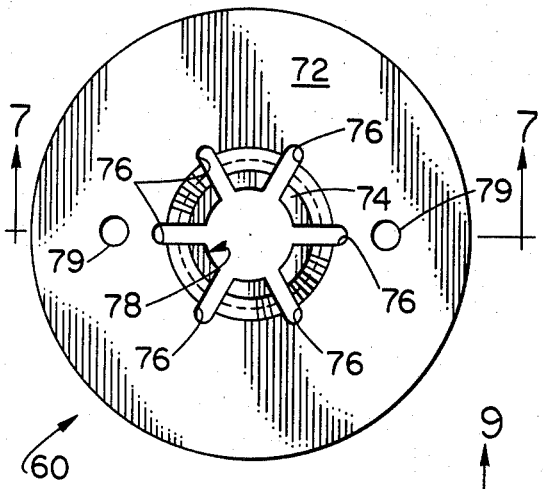
FIG. 6 is a top plan view of a retainer portion of a snap-on-grommet of the present invention.
Figure 8:
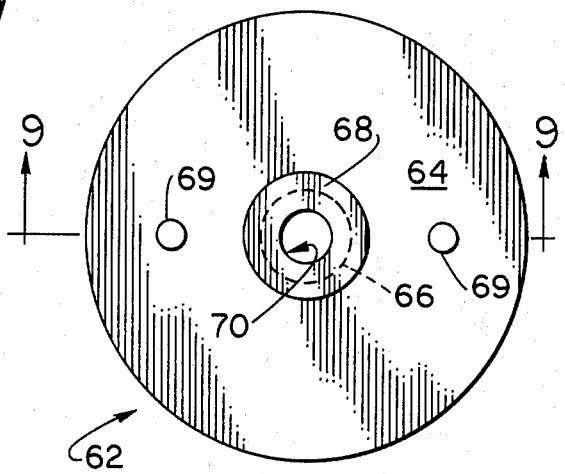
FIG. 8 is a top plan view of a base portion of a grommet of the present invention.
Figure 7:
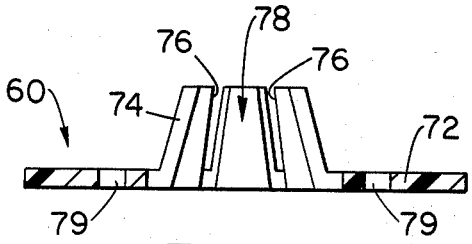
FIG. 7 is a sectional view of the retainer portion of FIG. 6 taken along line 7—7.
Figure 9:
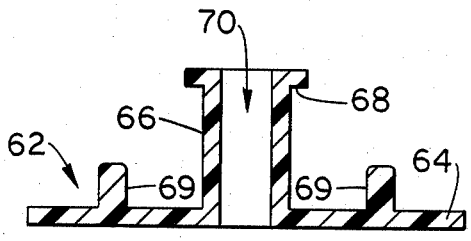
FIG. 9 is a sectional view of the base portion taken along line 9—9 of FIG. 8.

An enlarged side view of the spindle indicated generally at 28 is illustrated in FIG. 3 where the pinwheel 26 has been removed for purposes of clarity. The spindle 28 is an L-shaped member having an upper or first leg 32 and a lower or second leg 34. The legs 32 and 34 are perpendicular to each other and it is preferred that the legs 32 and 34 be of unitary construction. The cross section of the lower leg 34 is non-circular and preferably rectangular. Barbs 38 are provided at the top end of the first leg 32 to retain the snap-on-grommet 29, thereby retaining the pinwheel 26 on the spindle 28. A resting plate 31 is provided about the spindle 28 below the barbs 38 to prevent the grommet 29 from travelling down the first leg 32. A flat button 36 is securely mounted near the base of the first leg 32. A resting plate 39 is securely mounted on the first leg 32 above the button 36. Nibs 40 are provided on the first leg 32 above the water resting plate 39. When the pinwheel 26 is mounted on the spindle 28, it is retained between the washer resting plate 39 and the nibs 40. The resting plate 31, button 36, resting plate 39 and nibs 40 can be integrally constructed with the first leg 32.

Figure 4:
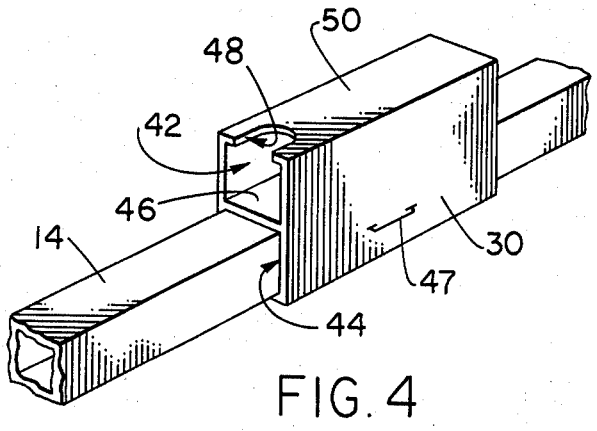
FIG. 4 is a perspective view of the bracket of FIG. 3 with the spindle removed for purposes of clarity of illustration.

The bracket 30, illustrated best in FIG. 4, includes an upper chamber 42 and a lower chamber 44. The two chambers 42 and 44 are divided by a partition 46. The lower chamber 44 has a rectangular cross section and slidably receives the center strut 14. If desired, a known fastener 47 can be used to secure the bracket 30 in place on the center strut 14. The complementary cross sections of the lower chamber 44 and the center strut 14 prevent the bracket 30 from rotating with respect to the center strut 14. The fastener 47 prevents the bracket 30 from sliding along the longitudinal axis of the center strut 14.

The upper chamber 42 of the bracket 30 has a rectangular cross section and slidably receives the lower leg 34 of the spindle 28. A cutout 48 is provided in an upper surface 50 of the upper chamber 42 to receive the first leg 32 of the spindle 28. When the lower leg 34 is inserted into the upper chamber 42, the button 36 rests on the upper surface 50 of the upper chamber 42. A leading end 35 of the lower leg 34 can be tapered to ease insertion into the upper chamber 42. It is desirable to provide nibs 37 on the outer diameter of the lower leg 34 adjacent to the end 35. The lower leg 34 is fully inserted into the upper chamber 42 so that the nibs 37 are beyond the bracket 30 and prevent the lower leg 34 from inadvertently sliding out of the upper chamber 42. The combinations of the button 36 resting on the upper surface 50 of the bracket 30 and the complementary cross sections of the lower leg 34 and the upper chamber 42 stabilize the spindle 28 in the bracket 30. Such stabilization prevents the pinwheel 26 from rotating or twisting with respect to the center strut 14, thereby eliminating contact between the pinwheel 26 and the body 18 of sheet material. If the pinwheel 26 were to engage the body 18 of sheet material, damage such as tears and rips could occur and prevent the kite 10 from flying. Also, pinwheel rotation could be impeded if the spindle 28 were permitted to wobble about the center strut 14.

Figure 5:
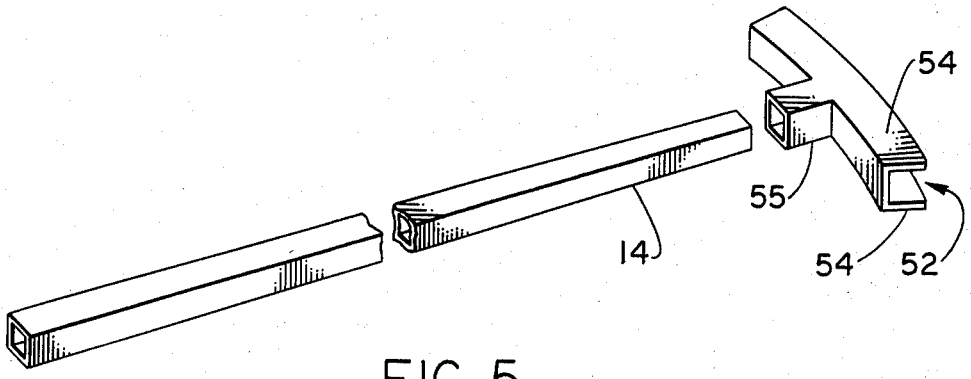
FIG. 5 is an exploded perspective view of an arcuate channel member having a recess for insertion of a center strut.

As illustrated in FIG. 5, an arcuate channel member 52 is provided for connecting and stabilizing the center strut 14 to the framing strut 12. The channel member 52 includes a pair of arcuate flanges 54 and a recess 55 having a rectangular cross section. The flanges 54 form an open channel having a rectangular cross section for receiving the framing strut 12 at its apex. Once the framing strut 12 is inserted into the channel, rotation of the center strut 14 with respect to the channel member 52 is prevented. The center strut 14 is inserted into the recess 55 and prevents rotation of the channel member 52 with respect to the center strut 14.

When the kite 10 is flown, the pinwheel 26 is rotated by the wind. Wind gusts also attempt to vibrate and rock the pinwheel 26 from side to side. However, the pinwheel 26 is stabilized by the channel member 52 and the bracket 30. The channel member 52 prevents the center strut 14 from rotating or twisting with respect to the framing strut 12. The bracket 30 prevents the spindle 28 from rotating or twisting with respect to the center strut 14.

It may be desirable to package and transport the kite 10 of the present invention with the pinwheel 26 in a flat position or not attached to the center strut 14. In such instances, a two-piece grommet or snaptogether fastener, illustrated in FIGS. 6–12, is included with the kite 10 to secure the vane tabs 27A and 27B of the pinwheel 26 to the spindle 28. The snap-on-grommet 29 includes a retainer portion 60, illustrated in FIGS. 6 and 7, and a base portion 62, illustrated in FIGS. 8 and 9. The base portion 62 includes a thin plate 64 and a stem 66 projecting perpendicularly from the plate 64. The stem 66 includes a lip 68 and a longitudinal opening 70. A pair of retaining pins 69 are placed on opposite sides of the stem 66 and project perpendicularly from the plate 64.

The retainer portion 60 includes a thin plate 72 and a cone 74 projecting perpendicularly from the plate 72. The cone 74 includes longitudinal slots 76 and a longitudinal opening 78. A pair of apertures 79 are spaced on opposite sides of the cone 74. The apertures 79 are constructed and arranged to receive the retaining pins 69 of the base portion 62 as described below.

Figure 10:
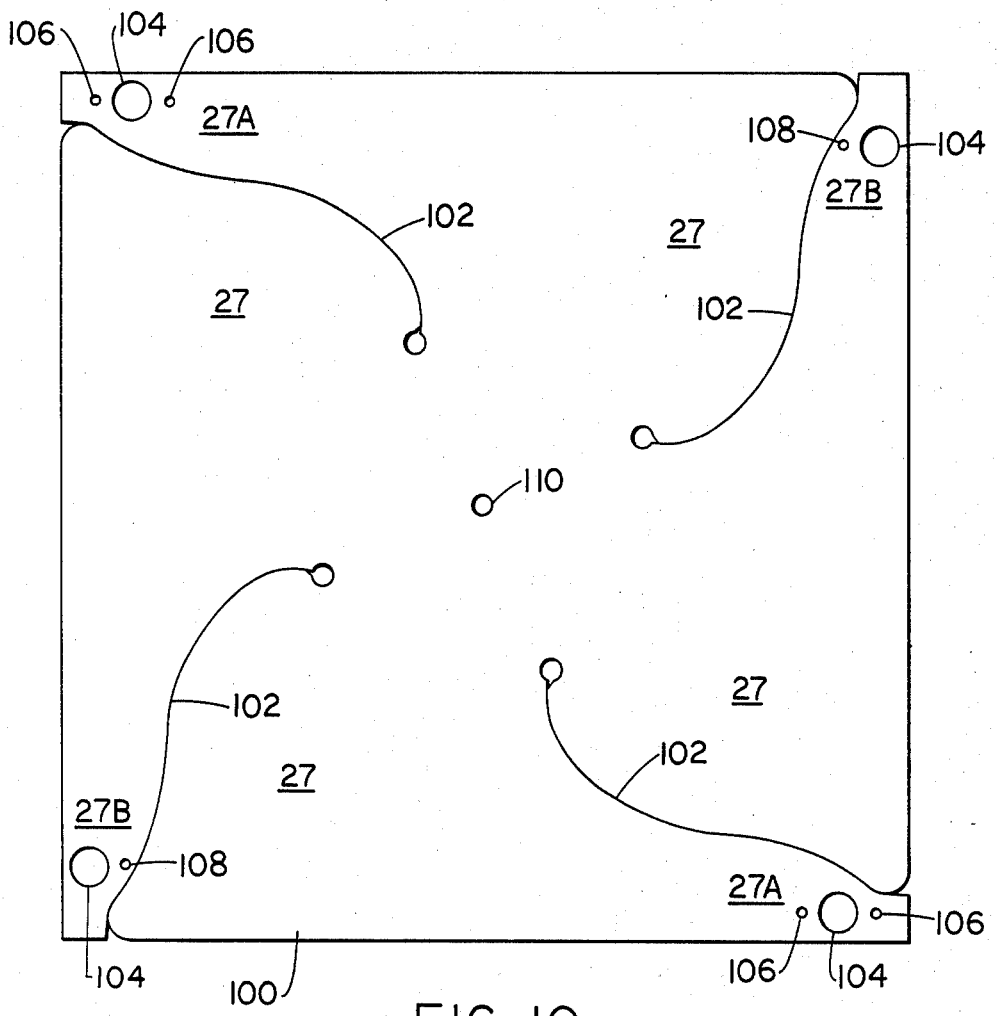
FIG. 10 is a top plan view of an unfolded pinwheel of the present invention.

As illustrated in FIG. 10, a blank 100 for forming a pinwheel 26 includes cuts 102 to divide the blank 100 into vanes 27 and vane tabs 27A and 27B. The vane tabs 27A and 27B are secured between the base portion 62 and retainer portion 60 of the snap-on-grommet of FIGS. 6–9. Apertures 104 are provided in each vane tab 27A and 27B and are of sufficient size to receive the stem 66 of the base portion 62. Vane tabs 27A include a pair of openings 106 on opposite sides of aperture 104. Openings 106 are of sufficient size to receive the pins 69 of the base portion 62. Vane tabs 27B include a single opening 108 of sufficient size to receive a pin 69 in a manner described below. A central aperature 110 is inserted on the first leg 32 of the spindle 28 and is positioned between the washer resting plate 39 and nibs 40 (see FIG. 3). Blanks of other configurations are within the scope of the present invention.

Figure 12:
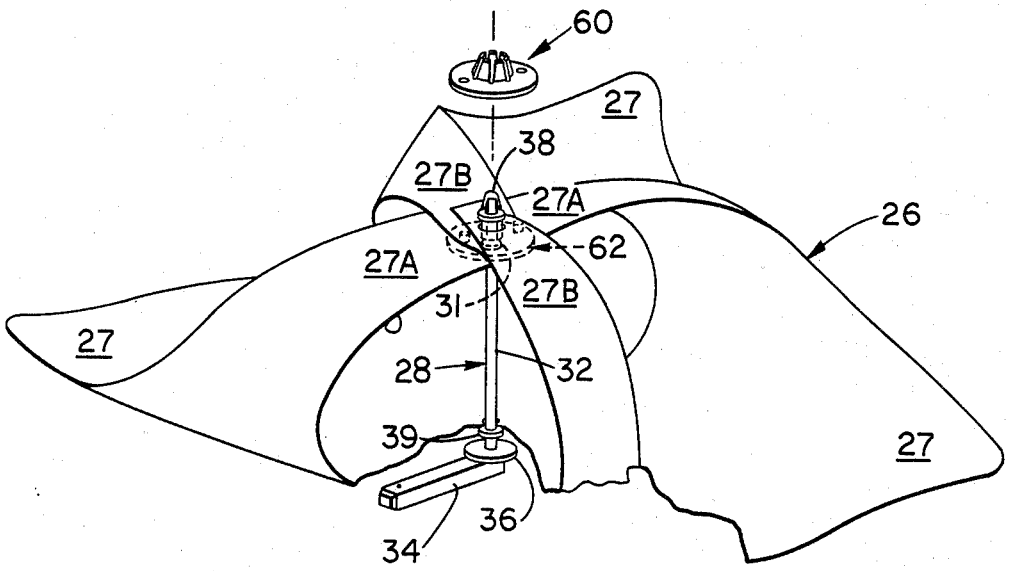
FIG. 12 is a partial fragmentary, exploded perspective view showing the vane tabs of the pinwheel mounted between the retainer and base portions of the snap-on-grommet.
Figure 11:
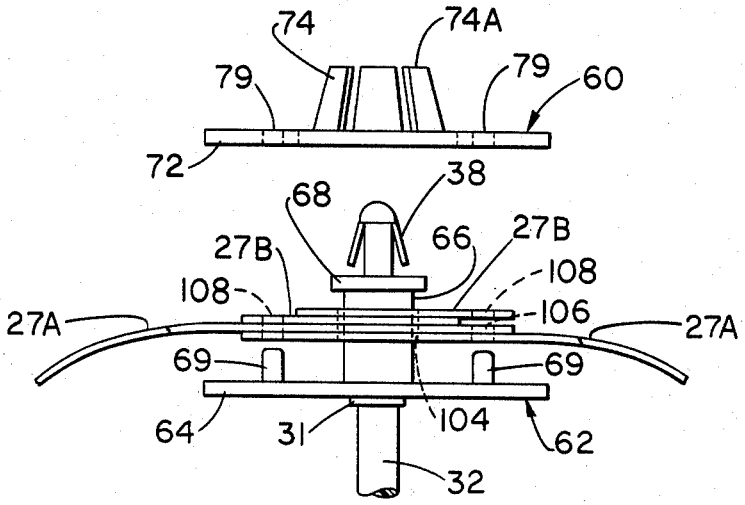
FIG. 11 is a side elevation view showing the vane tabs of the pinwheel mounted between the retainer and base portions of the snap-on-grommet.

Assembly of the vane tabs 27A and 27B of blank 100 on the spindle 28 is illustrated in FIGS. 11 and 12. Base portion 62 is inserted over the first leg 32 of the spindle 28 and rests on the resting plate 31. Vane tabs 27A are bent so that apertures 104 receive the stem 66 and openings 106 receive pins 69. Vane tabs 27B are bent so that apertures 104 receive the stem 66 and openings 108 receive pins 69. Retainer portion 60 is inserted over the stem 66. When assembled, the vane tabs 27A and 27B of the blank 100 are held in place between the plate 64 of the base portion 62 and the plate 72 of the retainer portion 60. The cone 74 is forced over the lip 68 of the base portion 62. As the cone 74 is slid over the lip 68, the slots 76 allow the cone 74 to expand and then return to its approximate original position. The top surface 74A of the cone 74 is retained by the lip 68. The lip 68 is retained on the first leg 32 by the barbs 38. In this manner, the blank 100 forms a pinwheel 26 that is retained on the spindle 28. It is preferred that the retainer portion 60 be constructed from a resilient material so that the cone 74 will return to its approximate original position after being stretched over the lip 68. The pins 69 and openings 106 and 108 of the vane tabs 27A and 27B, respectively, prevent the vane tabs 27A and 27B from twisting or moving with respect to each other, thereby preventing the pinwheel 26 from wobbling on the spindle 28. Prevention of wobbling causes the pinwheel 26 to freely rotate on the spindle 28.

As illustrated in FIG. 2, it is important that the bridle 20 be of sufficient length so as not to interfere with the rotation of the pinwheel 26.

In view of the foregoing description of a preferred embodiment of our invention, those skilled in the art will recognize that the principles of the invention can be applied in various ways.

The kite illustrated in the drawings and described above is subject to structural modifications without departing from the spirit and scope of the appended claims.

Although the invention has been illustrated and described in connection with a single specific embodiment, it is to be understood that the inventive concept is not limited to the specific structure shown.

Having described our invention, what we claim as new and desire to secure by Letters Patent is:

1. A kite comprising:

a. a framing strut;

b. a center strut of tubular construction;

c. a body of sheet material secured to the framing strut and the center strut;

d. stabilizing means comprising a channel member having a pair of flanges constructed and arranged to receive the framing strut and a recess to receive the first end of the center strut for connecting a first end of the center strut to the framing strut and preventing the center strut from rotating with respect to the framing strut;

e. a pinwheel having vane tabs mounted on a spindle; and f. bracket means for removably connecting the pinwheel to the center strut and preventing the pinwheel from contacting the sheet material wherein the bracket means comprises a bracket having parallel first and second chambers, wherein the first chamber is constructed and arranged to slidably receive the center strut, and the second chamber is constructed and arranged to slidably receive the spindle of the pinwheel.

2. The kite as specified in claim 1 and including snap-on-grommet means for assembling and aligning rotation of the pinwheel for placement on the spindle, wherein the snap-on-grommet means comprises:

(a) a base portion having a stem for receiving the spindle; and (b) a retainer portion having a slotted cone, whereby the vane tabs of the pinwheel are retained between the base portion and the retainer portion when the slotted cone is inserted on the stem.

3. The kite as specified in claim 2 wherein:

(a) the base portion of the snap-on-grommet means has a plurality of retaining pins receivable by aligned apertures in the retainer portion of the snap-on-grommet means; and (b) the vane tabs of the pinwheel have aligned openings for receiving the retaining pins when the base and retainer portions are assembled.

4. A kite of the type having a framing strut, center strut, and a body of sheet material secured to the framing strut and the center strut, wherein the improvement comprises:

a. a pinwheel having vane tabs mounted on an L-shaped spindle, the pinwheel removably mounted on the center strut;

b. a bracket having first and second chambers, wherein the first chamber is constructed and arranged to slidably receive the center strut and the second chamber is constructed and arranged to slidably receive a leg of the L-shaped spindle;

c. stabilizing means comprising a channel member having a pair of flanges for receiving the framing strut and a recess for receiving the center strut which is of a tubular construction for preventing the center strut from twisting with respect to the framing strut so that the pinwheel does not contact the sheet material; and d. a snap-on grommet means for securing the vane tabs about the spindle so that the pinwheel does not wobble on the spindle during rotation.

5. The kite as specified in claim 4 wherein the grommet means comprises:

(a) a base portion having a plate, a stem projecting perpendicularly from the plate for receiving the spindle, and a plurality of retaining pins projecting perpendicularly from the plate; and (b) a retainer portion having a plate and a slotted cone projecting perpendicularly from the plate for receiving the stem;

whereby openings in the vane tabs of the pinwheel are inserted into the retaining pins when the base and retainer portions are assembled.

6. A kite comprising:

(a) a U-shaped framing strut;

(b) a tubular center strut;

(c) an arcuate channel member having a recess to receive a first end of the center strut and a pair of aligned flanges for receiving an apex of the framing strut;

(d) a body of sheet material secured to the framing strut and center strut;

(e) an L-shaped spindle having first and second legs forming the L-shape and having vane tabs of pinwheel mounted on the said first leg; and (f) a bracket having first and second chambers, wherein the first chamber slidably receives the said second leg of the L-shaped spindle and the second chamber slidably receives the center strut.

7. The kite as specified in claim 6 wherein:

(a) the center strut is of non-circular cross section and the second chamber of the bracket is of complementary cross section; and (b) the second leg of the L-shaped spindle is of non-circular cross section and the first chamber of the bracket is of complementary cross section.

8. The kite as specified in claim 6 including a snap-on-grommet for assembling and aligning the rotation of the pinwheel for placement on the L-shaped spindle, wherein the snap-on-grommet comprises a base portion having a stem inserted on the first leg of the spindle, and a retainer portion having a slotted cone, whereby vane tabs of the pinwheel are retained between the base portion and the retainer portion when the slotted cone is inserted on the stem.

9. The kite as specified in claim 8 wherein:

(a) the base portion of the snap-on-grommet includes a plurality of retaining pins; and (b) the vane tabs of the pinwheel include openings for receiving the retaining pins when the pinwheel is mounted on the spindle.

* * * * *